United States Patent [19]

Farnham

[11] Patent Number: 4,457,837

[45] Date of Patent: Jul. 3, 1984

[54] EFFICIENCY ADDITION OF AMMONIA TO PETROLEUM FRACTIONATION UNITS

[75] Inventor: Robert A. Farnham, San Rafael, Calif.

[73] Assignee: Chevron Research Company, San Francisco, Calif.

[21] Appl. No.: 401,340

[22] Filed: Jul. 23, 1982

[51] Int. Cl.[3] ..... C10G 7/10

[52] U.S. Cl. ..... 208/362; 208/47; 208/236; 208/363

[58] Field of Search ..... 208/362, 47, 236, 363; 203/29, 96; 423/352

[56] References Cited

U.S. PATENT DOCUMENTS

| | | | |
|---|---|---|---|
| 2,162,933 | 6/1939 | Bolinger et al. | 208/47 |
| 2,310,837 | 2/1943 | Carpenter et al. | 208/47 |
| 3,024,171 | 3/1962 | Bone, Jr. | 208/47 |
| 3,170,866 | 2/1965 | Wendt, Jr. | 208/47 |
| 3,272,736 | 9/1966 | Petro et al. | 208/47 |
| 3,365,374 | 1/1968 | Short et al. | 208/236 |
| 3,383,173 | 5/1968 | Bollen | 423/352 |
| 3,404,072 | 10/1968 | Bollen et al. | 423/352 |
| 3,518,166 | 6/1970 | Flett | 423/352 |
| 4,060,591 | 11/1977 | Garber et al. | 423/352 |
| 4,062,764 | 12/1977 | White et al. | 208/348 |
| 4,229,284 | 10/1980 | White et al. | 208/348 |

FOREIGN PATENT DOCUMENTS

| | | | |
|---|---|---|---|
| 35257 | 4/1978 | Japan | 203/96 |
| 35258 | 4/1978 | Japan | 203/96 |
| 565026 | 4/1978 | U.S.S.R. | 203/96 |

*Primary Examiner*—Delbert E. Gantz
*Assistant Examiner*—Cynthia A. Prezlock
*Attorney, Agent, or Firm*—Burns, Doane, Swecker & Mathis

[57] ABSTRACT

A nonpolluting process for neutralizing corrosive acid components in the overheads of petroleum distillation units is disclosed. In the process, ammonia is added to said units and carried overhead. The overhead is condensed to yield hydrocarbon phase and an ammonia-containing aqueous phase. The aqueous phase is stripped to yield an ammoniacal steam that is returned to the distillation units and a substantially ammonia-free bottoms.

9 Claims, 3 Drawing Figures

EFFICIENCY ADDITION OF AMMONIA TO PETROLEUM FRACTIONATION UNITS

FIELD OF THE INVENTION

This invention relates to the fractionation of petroleum. More particularly, it concerns an improved efficiency method for neutralizing corrosive acidic components in petroleum distillation units.

THE PRIOR ART

Crude oil is conventionally subjected to distillation and vacuum distillation. It is recognized that in these distillations acidic materials such as sulfur acids and halo acids are formed from inorganic and/or organic materials present in all crudes and are carried overhead with the distillate product and are concentrated in water also normally present in the overhead. This acidic water is very corrosive to conventional materials of construction.

In the past, ammonia, amines, and like bases have been added to these distillation systems to attempt to neutralize the corrosive acids. U.S. Pat. Nos. 4,062,764 and 4,229,284 are typical references to these conventional amine additions. Ammonia is a favored material as it is less expensive, volatile and will go overhead with the water fraction and volatile acids as is desired. Also, it is a relatively inexpensive neutralizing agent.

The use of ammonia has some drawbacks, too. Since it is not feasible to always provide exactly the right amount of ammonia, addition of an excess is favored over accidental acidity and corrosion. Much of this excess dissolves in the condensed overhead water. Ammonia-contaminated water is an undesirable byproduct. Ammonia is toxic and most refineries have strict limits on how much they can discharge into the environment. In addition, ammonia is a difficult to biotreat waste as it is a nutrient for algae and has been observed to promote algae growth to the point that the waste effluent may contain greater-than-permitted levels of suspended solids. Thus, while it is beneficial to have ammonia in these systems, its presence is also a problem. Any method for dealing with the problem should be effective and energy efficient.

STATEMENT OF THE INVENTION

It has now been found that the problems of ammonia in aqueous condensates resulting from crude oil distillation are solved by isolating the condensate, steam stripping the condensate in a stripper column to yield an ammonia-free bottoms and an ammoniacal steam overhead and recycling the ammoniacal steam overhead to the crude oil distillation columns to replace a portion of the bottoms stripping steam. This advantageous process may be used with or without a net generation of steam in the stripper column. In addition, caustic may optionally be added to the aqueous condensate prior to or during stripping to react with acid contaminant ammonium compounds and release ammonia.

BRIEF DESCRIPTION OF THE DRAWINGS

The invention will be described with reference to the drawings in which.

DETAILED DESCRIPTION OF THE INVENTION

Figure 1:
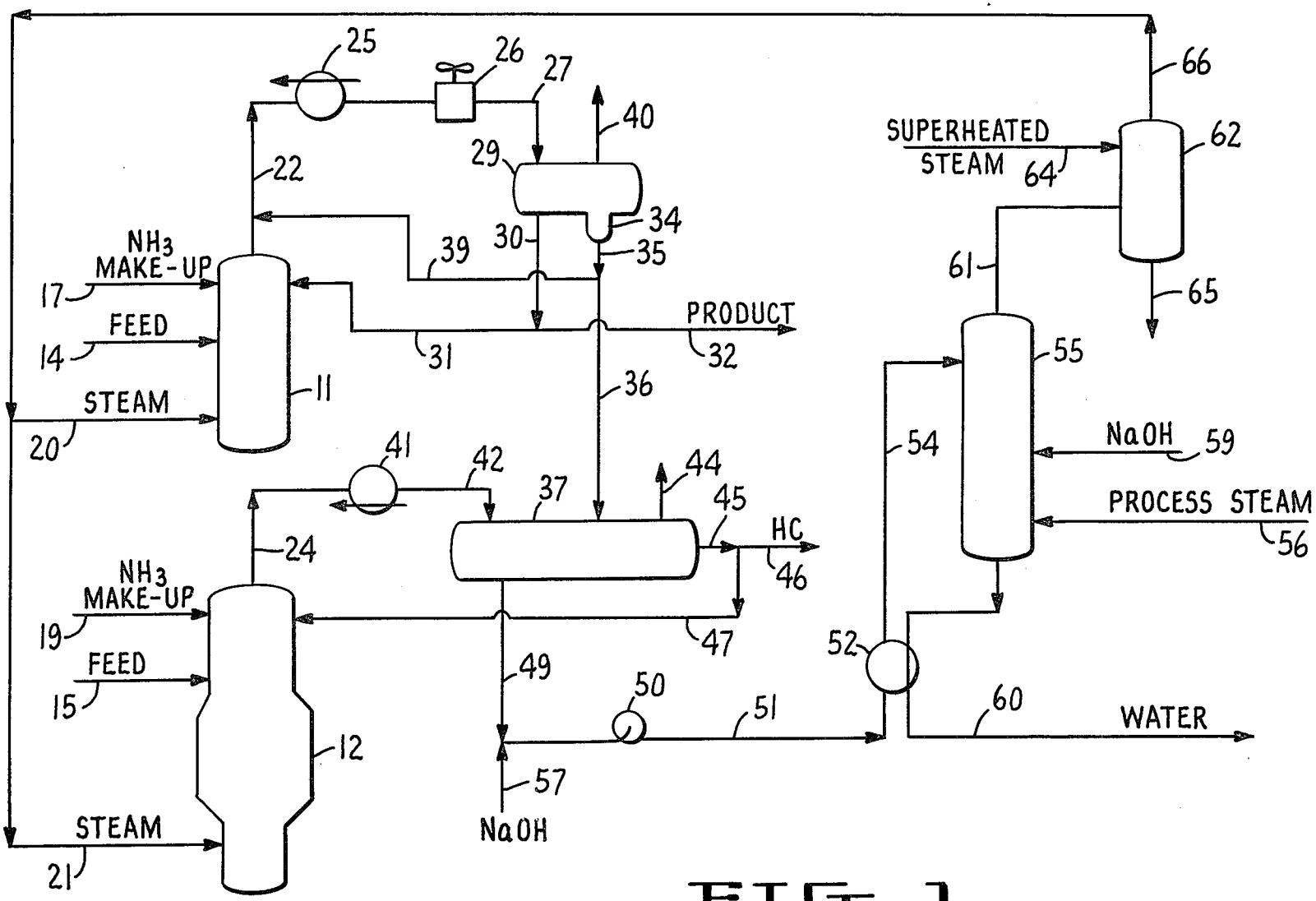
FIG. 1 is a schematic flow diagram of the process.

Referring more particularly to the schematic figures of the drawing, in FIG. 1 two petroleum distillation columns, atmospheric column 11 and vacuum column 12, are shown as representative of crude petroleum processing units conventionally treated with ammonia to neutralize corrosive acids released from the petroleum. Petroleum feed is charged to the columns via lines 14 and 15, respectively. Make up ammonia is added to the upper regions of these columns via lines 17 and 19, respectively, while stripping steam is added lower in the columns via lines 20 and 21, respectively.

The ammonia is carried overhead and is removed via lines 22 and 24. The overhead fractions from the columns contain hydrocarbon distillate materials, water and acidic materials such as HCl and $H_2S$ in addition to the ammonia. The overhead fractions are condensed. This is shown with atmospheric column 11 where its overhead is condensed in condensers 25 and 26 and passed via line 27 to reflux drum 29 where the hydrocarbon distillate is separated from the condensed aqueous overhead and a vapor phase. A portion of the hydrocarbon distillate is returned to the distillation column via lines 30 and 31 as reflux. The remainder is withdrawn as product via lines 30 and 32. The aqueous overhead is collected in boot 34 of reflux drum 29 and is taken off via lines 35 and 36 to seal drum 37. Optionally, as is shown, a portion of the aqueous condensate is recycled to line 22 via line 39 at a point prior to condenser 25. This optional recycle prevents the deposition of ammonium chloride solids in the condenser and avoids plugging or drops in efficiency. A vapor phase is removed from drum 29 via line 40.

The vacuum column overhead removed via line 24 is condensed in condenser 41 and passed through line 42 to seal drum 37. In the seal drum three phases are separated—a vapor phase taken off via line 44; a hydrocarbon phase removed via lines 45 and 46 to product and via lines 45 and 47 to vacuum column reflux; and an aqueous phase which is removed via line 49. Some ammonia and $H_2S$ is removed from the system with the vapor phases removed via lines 40 and 44 but the majority of the ammonia and ammonium compounds is present in the aqueous phase. The aqueous phase is pumped via pump 50 and lines 51 and 54 through heat exchanger 52 to the upper section of stripper column 55. Process steam is added via line 56. Optionally, a solution of caustic is added to the seal drum aqueous phase either via line 57 to the aqueous condensate feedstock or directly to the lower tray section of column 55 via line 59. The amount of caustic is controlled. The caustic reacts with acidic ammonium compounds to free ammonia. Stripper bottoms, substantially free of ammonia and containing salts and other low volatility materials is taken off via line 60 preferably for use as crude oil desalting water. The stripper overhead is taken off via line 61 to mixing drum 62 where steam is added via line 64. Any condensate that may be present is removed via line 65 to drum 37. Ammoniacal steam is recycled to line 20 and 21 via line 66.

Figure 2:
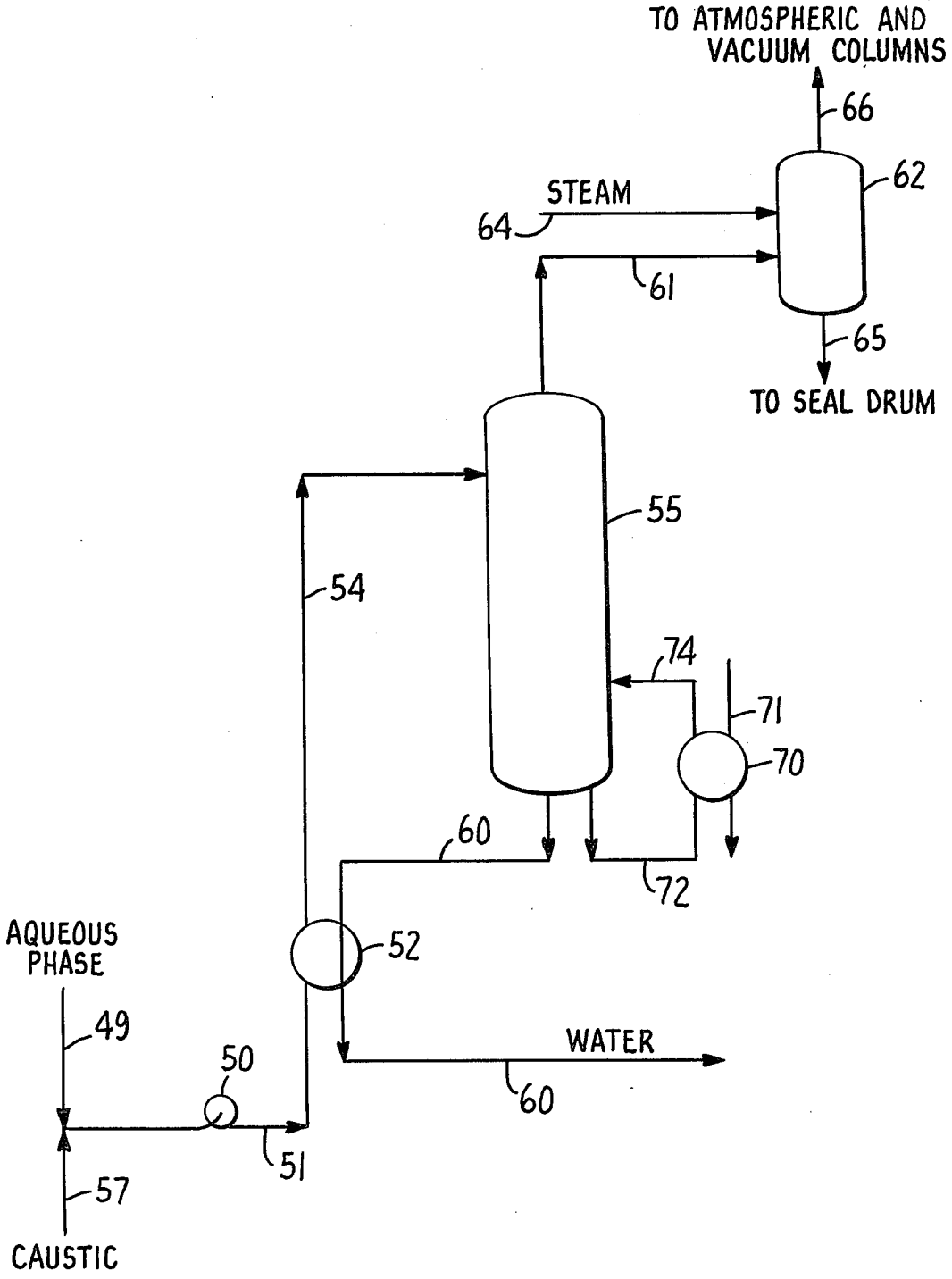
FIG. 2 is a schematic which shows a variation of one part of the flow scheme of the process.

In FIG. 2, a variation of the process is shown with previously shown items numbered as before. In the stripper column, instead of adding process steam, a reboiler 70 is employed. Reboiler 70 advantageously employs as its source of heat a hot process stream 71 in need of cooling and is incorporated via lines 72 and 74. This has the advantage of utilizing waste heat and inherently generating steam which can be employed as stripping steam in the petroleum distillation columns.

This process is of general applicability and is not limited to any particular distillation configuration or feedstocks and may be modified as would be apparent to those skilled in the art.

The following illustrative embodiment of the invention presents, on a production scale, the ammonia recycle process of the invention as shown in FIG. 2. In this embodiment a representative net distillation column ammoniacal aqueous condensate would be about 74,000 lbs/hr and would typically contain from 60 to 450, and more typically 125 to 200 ppm of ammonia. This material would enter the stripper column as a liquid, that is at a temperature below the boiling point of water at the column's pressure. The stripper column usually is run at a positive pressure such as from 40 to 100 psia, typically from 50 to 80 psia. For a stream this size, this column very suitably is three feet in diameter with 2 to 20 trays and more typically 2 to 12 trays of about 50% theoretical efficiency. The column is reboiled at about the boiling point of water at the column pressure. A stripper bottoms, containing about 0 to 15, and more usually 3 to 10 ppm of ammonia is removed at a rate of 70% to 95% of the feed rate. Bottoms removal preferably is controlled to from 80% to 90% of the feed. For example with a 74,000 lb/hr feed, an 85% bottoms (63,000 lbs/hr) is very acceptable. The bottoms water may be sent to conventional waste water units for final clean up and discharge or is very suitable for process use such as desalting water or the like. The remaining 5% to 30%, and preferably 10 to 20% of the feed (e.g. about 11,000 lbs/hr) is removed as ammoniacal steam overhead containing from about 200 to about 2000 ppm of ammonia for recycle to the distillation columns in combination with make-up steam (e.g. about 12,000 lbs/hr).

Figure 3:
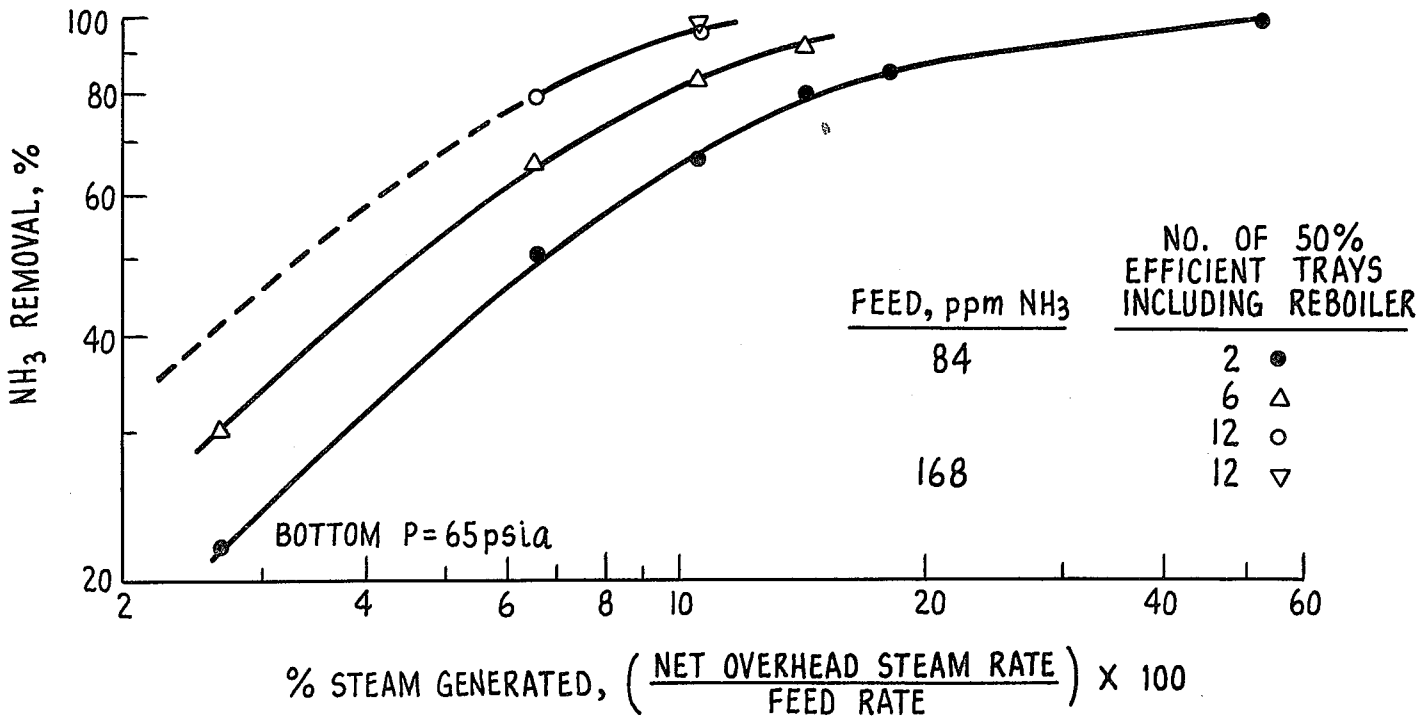
FIG. 3 is a graph setting forth ammonia removal efficiencies as a function of stripper column tray count and overhead fraction.

A series of calculations were run to determine the effect of variables on the ammonia removal in the ammonia/water stripper column. The variables were number of trays (of 50% theoretical efficiency), fraction of material overheaded, and ammonia concentration in the feed. These calculations produced the results shown in FIG. 3 and demonstrated that about 2 such trays may be adequate while 12 such trays is an upper boundary for reasonable steam generation rates.

Although various specific embodiments of the invention have been shown and described, it is to be understood that they are meant to be illustrative only and not limiting. Certain features may be changed without departing from the spirit of the invention which is defined by the following claims.

I claim:

1. In a process for distilling petroleum in a distillation column in the presence of added ammonia and stripper steam wherein an aqueous ammonia-containing hydrocarbon overhead is formed, condensed and separated into an aqueous ammonia phase and a hydrocarbon phase, the improvement comprising recovering the aqueous ammonia phase, steam stripping ammonia from said aqueous ammonia phase in a stripper column, thereby yielding an ammoniacal steam stripper overhead and a substantially ammonia-free stripper bottoms and returning said ammoniacal steam to said distillation column as stripper steam.

2. The process of claim 1 wherein said stripper column comprises a reboiler such that steam is generated in said stripper column.

3. The process of claim 2 wherein caustic is added to said ammonia-containing petroleum column aqueous overhead prior to stripping.

4. The process of claim 2 wherein caustic is added to said stripper column.

5. The process of claim 1 wherein said stripper column does not comprise a reboiler such that no steam is generated in said stripper column.

6. The process of claim 5 wherein caustic is added to said ammonia-containing petroleum column aqueous overhead prior to stripping.

7. The process of claim 5 wherein caustic is added to said stripper column.

8. The process of claim 1 wherein said stripping column contains from 2 to 20 trays.

9. The process of claim 1 wherein said substantially ammonia-free bottoms contains from 0 to 15 ppm of ammonia.

* * * * *